US011325778B2

(12) United States Patent
Villaneda

(10) Patent No.: US 11,325,778 B2
(45) Date of Patent: May 10, 2022

(54) WASTEBASKET LINER

(71) Applicant: Michelle Villaneda, Rancho Cucamonga, CA (US)

(72) Inventor: Michelle Villaneda, Rancho Cucamonga, CA (US)

( * ) Notice: Subject to any disclaimer, the term of this patent is extended or adjusted under 35 U.S.C. 154(b) by 0 days.

(21) Appl. No.: 16/853,329

(22) Filed: Apr. 20, 2020

(65) Prior Publication Data

US 2021/0323760 A1 Oct. 21, 2021

(51) Int. Cl.
*B65F 1/06* (2006.01)
*B65F 1/00* (2006.01)

(52) U.S. Cl.
CPC ..... *B65F 1/0006* (2013.01); *B65F 1/06* (2013.01)

(58) Field of Classification Search
CPC ..... B65F 1/0006; B65F 1/06
USPC ..... 383/11, 14, 20, 17, 107; 220/495.08
See application file for complete search history.

(56) References Cited

U.S. PATENT DOCUMENTS

D165,782 S * 1/1952 Parker ..... D7/533
4,978,231 A 12/1990 Ling et al.
5,709,312 A * 1/1998 Lake ..... B65F 1/0006 215/319
5,913,606 A 6/1999 Nicholson
6,808,073 B2 10/2004 Cuisinier
6,837,394 B2 1/2005 Nnamani
7,137,737 B2 11/2006 Schneider
7,159,734 B1 * 1/2007 O'Brien ..... B44D 3/123 220/495.07
7,914,207 B1 3/2011 Beam
2002/0190069 A1 * 12/2002 Cuisinier ..... B65D 33/20 220/495.11
2003/0190097 A1 * 10/2003 Hajianpour ..... B65D 33/007 383/9
2004/0182866 A1 * 9/2004 Carrillo ..... B65F 1/002 220/495.06
2005/0129335 A1 * 6/2005 Paul ..... B65F 1/06 383/11
2006/0188177 A1 * 8/2006 Dyer ..... B65D 33/08 383/10
2007/0235456 A1 * 10/2007 Tamez ..... B65F 1/06 220/495.07
2010/0187234 A1 * 7/2010 Saranga ..... B44D 3/126 220/495.01

(Continued)

FOREIGN PATENT DOCUMENTS

FR 2720918 A1 12/1995
GB 2231027 A 11/1990
JP 2001-199502 A 7/2001

*Primary Examiner* — J. Gregory Pickett
*Assistant Examiner* — Niki M Eloshway
(74) *Attorney, Agent, or Firm* — Klein, O'Neill & Singh, LLP

(57) ABSTRACT

A wastebasket liner is configured to attach to an inner surface of a wastebasket so that the liner does not show conspicuously above a top rim of the wastebasket. The liner has an adhesive layer disposed on its outer surface at or adjacent a top edge of the liner so that the liner can be adhered in place within the wastebasket. One or more pull members are provided to assist in removing the liner from the wastebasket. Such pull member can be bonded to the liner, and has a free portion that is configured to be grasped by a user so that the user can easily pull on the liner to detach the adhesive from the wastebasket and remove the liner from the wastebasket.

18 Claims, 6 Drawing Sheets

(56) References Cited

U.S. PATENT DOCUMENTS

| | | | | |
|---|---|---|---|---|
| 2011/0164834 | A1* | 7/2011 | Stiglic | B65F 1/0026 383/75 |
| 2015/0183554 | A1* | 7/2015 | Kessler, Jr. | B65D 33/08 383/10 |
| 2017/0022003 | A1* | 1/2017 | Brady | B65F 1/06 |

* cited by examiner

WASTEBASKET LINER

BACKGROUND

The present disclosure relates to the field of wastebasket liners

Thin, plastic disposable wastebasket liners are used to line wastebaskets. When it comes time to remove waste collected therein, the liner can be removed and discarded, while the wastebasket remains unfouled by the waste. Typically, the liner is folded over the top of the wastebasket. However, some wastebaskets are part of the décor of the room in which they are placed, and when the liner is folded over the top of the wastebasket, it distracts from the pleasing look of the décor. As such, liners can have adhesive on their outer surface to attach the liner to the inside of the wastebasket rather than being folded over the top of the wastebasket. However, such configurations raise other issues such as, for example, how such a liner can be easily removed and managed, as well as how to deal with situations when the liner opening is larger than the wastebasket opening.

SUMMARY

The present specification discusses embodiments of wastebasket liners that can be used with wastebaskets without detracting from wastebasket design considerations and décor, and can also be managed effectively when being installed and removed from the wastebasket.

In accordance with a preferred embodiment, the present specification discloses a wastebasket liner, comprising a body extending from a top edge to a closed bottom, an opening being defined by the top edge, an adhesive layer disposed on an outer surface of the liner body at or adjacent the top edge, the adhesive layer extending substantially around the circumference of the liner body, and a pull member having a free portion extending from the liner and configured to be graspable by a user.

In some embodiments, the top edge lies in a plane, and the pull member extends upwardly from the top edge.

In additional embodiments, the pull member is formed separately from the liner body, and a connected portion of the pull member is bonded to the liner body, and wherein the free portion of the pull member extends from the connected portion.

In some such embodiments, the free portion of the pull member does not extend above the top edge of the liner. In further embodiments, the free portion of the pull member comprises a high-grip coating. In still further embodiments, the free portion of the pull member is bent downward. Yet additional embodiments comprise a second free portion extending from the connected portion in a direction other than upward. In yet additional embodiments, the free portion of the pull member can comprise a reinforcement member made of a different material than the liner body.

In additional embodiments, the liner body comprises a first liner wall and a second liner wall, a first edge of the first liner wall being bonded to a first edge of the second liner wall along a length of the liner body and a second edge of the first liner wall being bonded to a second edge of the second liner wall along the length of the liner body, and a connected portion of the pull member is sandwiched between the bonded first edges along a portion of the length of the liner body, and the free portion of the pull member extends towards the second edges.

In yet additional embodiments, the connected portion of the pull member is bonded to an inner surface of the liner body and the free portion extends laterally from the connected portion, and wherein the free portion comprises a secondary adhesive layer. In some such embodiments, the free portion extends both laterally and proximally from the connected portion, and the secondary adhesive layer is disposed on only a portion of the free portion. In further embodiments, the secondary adhesive layer is configured to selectively engage the inner surface of the liner body.

In still further embodiments, the liner comprises a hem at and adjacent the top edge about the circumference of the opening, the hem comprising an inner wall and an outer wall that define a hem space, a draw tape disposed in the hem space, wherein a cutout is formed to provide access to the hem space, and wherein the adhesive strip is connected to the outer wall.

In some such embodiments, the cutout is formed through the inner wall, and the adhesive strip is connected to the outer wall opposite the cutout.

In some such embodiments, the pull member can comprise the draw tape. In other such embodiments the pull member connected portion is bonded to the draw tape.

In accordance with another embodiment, the present specification describes a method of installing a wastebasket liner into a wastebasket. The method comprises advancing the wastebasket liner through an opening of the wastebasket, removing a cover from an adhesive strip disposed on an outer surface of the wastebasket liner adjacent a top edge of the liner, and adhering the adhesive strip to an inner surface of the wastebasket about a circumference of the wastebasket. An excess portion of the liner is directed radially inwardly and overlapping the liner in the excess portion so that the adhesive strip is adhered to itself in the excess portion and a pull member bonded to an inner surface of the liner is disposed at a radially-inward end of the excess portion. A cover is removed from a secondary adhesive layer disposed on a free portion of the pull member, and the secondary adhesive layer is adhered to the inner surface of the liner so that the excess portion lies substantially flat against the inner surface of the liner.

In some such embodiments, a connected portion of the pull member is bonded to the inner surface of the liner, and part of the free portion extends proximally from the connected portion.

DESCRIPTION

Figure 1:
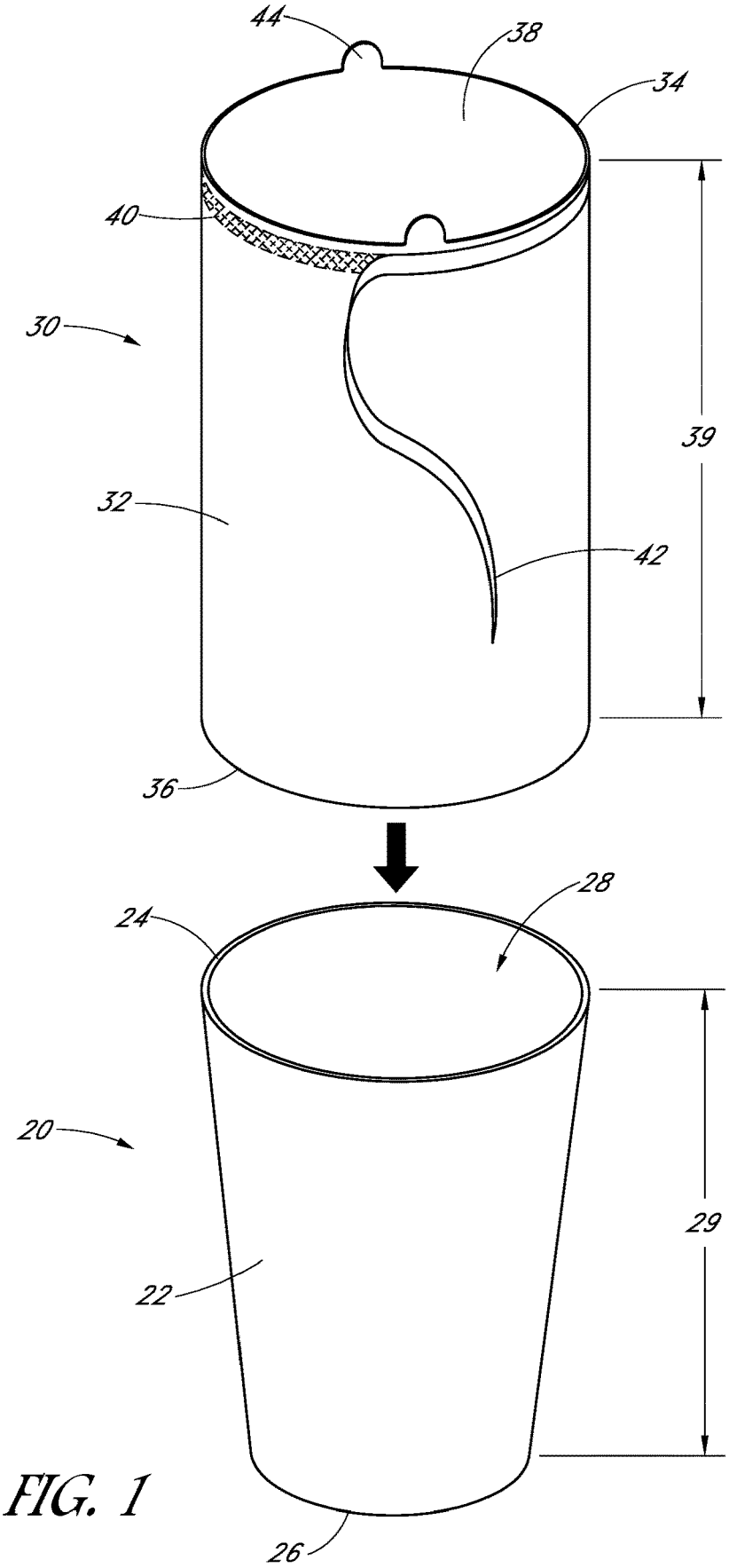
FIG. 1 is a perspective view of an embodiment of a wastebasket liner about to be installed in a wastebasket.

With initial reference to FIGS. 1-4, a typical wastebasket or trash can 20 comprises a can body 22 extending from a proximal or top rim 24 to a distal or bottom end 26. An opening 28 is defined at the top rim 24. The bottom end 26 preferably is closed. A height 29 is defined from the top rim 24 to the bottom end 26. A size of the opening 28 can be defined by a radius and/or circumference at the top rim 24. The illustrated embodiment is a relatively small wastebasket 20, such as about 4 gallons, configured, for example, for use in a small room such as a bathroom, bedroom, office or den. Although principles discussed herein can be applied to trash cans of various sizes, shapes, and uses, the illustrated embodiment portrays such a small trash can preferably configured to complement the décor of the associated room. For example, a bedroom may have a distinctive color palette and/or other design themes, and the illustrated trash can 20 preferably matches such palette and/or design themes.

With particular reference to FIG. 1, a flexible wastebasket liner 30 comprises a liner body 32 that extends from a proximal, or top, edge 34 to a closed distal, or bottom, end 36. An opening 38 is defined at the top edge 34. A height 39 is defined extending from the top edge 34 to the bottom end 36. In the illustrated embodiment, the liner height 39 preferably is greater than the can height 29 by about 2-4 inches. A size of the opening 38 can be defined by a radius and/or a circumference taken at the top edge 34.

The liner 30 preferably is formed of a thin plastic, such as a thin thermoplastic typically used in such applications, which is flexible and durable so as to facilitate its use as a trash bag. In some embodiments the liner can be made of other materials, such as paper, or even combinations of multiple materials. Liner embodiments made of plastics can be constructed in multiple ways. For example, the liner 30 in FIG. 1 was formed via a tubular plastic extrusion that was cut to define the top edge and bottom end, and the bottom end was bonded—or welded—closed, such as by heat-welding. In other embodiments a liner can be formed by placing two flat layers of plastic adjacent one another and bonding/welding them along their edges and at the bottom end. It is to be understood that these, and other, methods can be employed to form liners having one or more of the inventive features disclosed herein.

With continued reference to FIG. 1, an adhesive layer 40 is applied to an outer surface of the liner 30 at or immediately adjacent the top edge 34. Preferably, the adhesive layer 40 extends contiguously about the entire circumference of the liner 30. In a preferred embodiment, the adhesive layer 40 is between about ¼-½ inch wide. In the illustrated embodiment, the adhesive layer 40 is spaced a short distance from the top edge 34—preferably less than ½ inch and more preferably less than about ¼ inch. In additional embodiments the upper edge of the adhesive layer 40 is at and collinear with the top edge 34. Preferably, a peel-off cover 42 is disposed on the adhesive layer 40, and can be peeled off immediately before the adhesive layer is used.

The top edge 34 of the liner 30 illustrated in FIG. 1 is flat about its circumference, except that two pull members 44 extend upwardly from the top edge 34 on opposite sides. Put another way, the illustrated top edge 34 lies in a plane except for the pull members 44. In the illustrated embodiment, the pull members 44 are unitarily formed as part of the liner 30.

Figure 2:
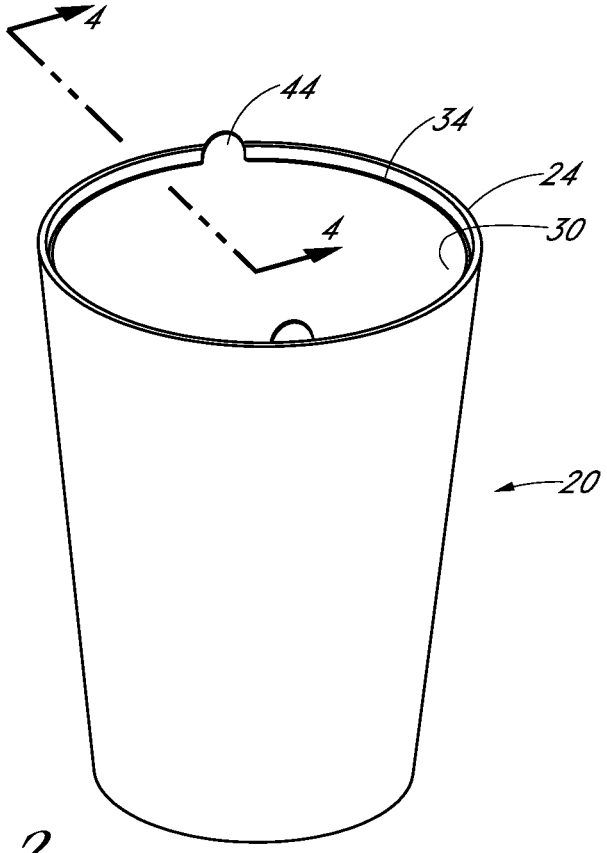
FIG. 2 shows the configuration of FIG. 1 with the liner installed in the wastebasket.
Figure 4:
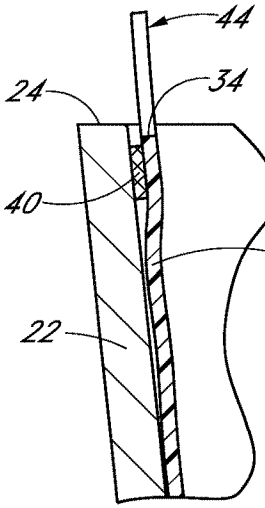
FIG. 4 is a schematic cross-sectional view taken along lines 4-4 of FIG. 2

With additional reference to FIGS. 2 and 4, the liner 30 is installed on the wastebasket 20 by pushing the liner body 32 distally through the opening 28 and into the wastebasket 20. The peel tape 42 is removed to expose the adhesive layer 40, and the exposed adhesive layer 40 is pushed against the inner surface of the wastebasket 20 just below the rim 24 so that the top edge 34 of the liner 30 is below the rim 24. In the illustrated embodiment, the pull members 44 extend upwardly barely above the rim 24. In this configuration, the liner 30 does not substantially interfere with the esthetic appearance of the wastebasket 20. In additional embodiments the liner 30 can be placed so that the pull members 44 do not extend above the rim 24. In the illustrated embodiment, since the liner 30 has a greater height 39 than does the wastebasket 20, at least a portion of the liner body 32 can be expected to fold or crinkle within the wastebasket 20 along the sides of the wastebasket body 22.

Figure 3:
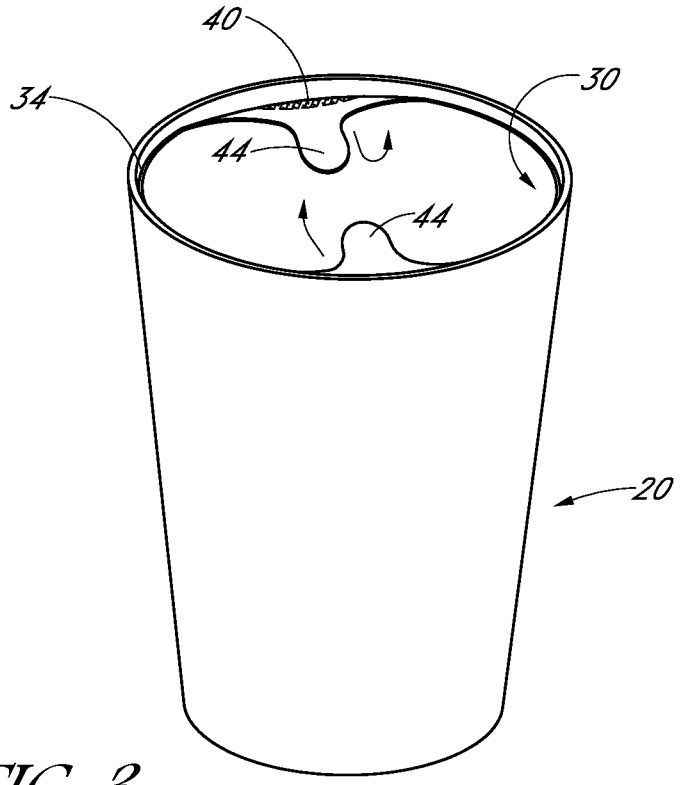
FIG. 3 shows the configuration of FIG. 2 while the liner is being removed.

With additional reference to FIG. 3, when it is time to remove the liner 30 from the wastebasket 20, a user can grasp one or both of the pull members 44 in order to obtain purchase on the liner 30. Preferably the user pulls the pull member 44 radially inwardly so as to disconnect the adhesive layer 40 from the inner surface of the wastebasket 20 immediately adjacent the pull member 44. Continued pulling of the pull member radially inwardly and then upwardly will continue to peel the adhesive layer 40 from the inner surface of the wastebasket 20 until the entire adhesive layer 40 is detached from the wastebasket 20.

In a preferred embodiment, the height 39 of the liner 30 is greater than the height 28 of the wastebasket. Thus, the pull member 44 (and thus top edge 34) can be pulled upwardly clear of the wastebasket 20 before any of the trash within the liner 20 need be lifted upwardly. During initial upward pulling of the pull member 44, the body 32 of the liner 30 will instead unfold. As such, the user can employ an initial upward pull to free the adhesive layer 40 from the wastebasket 20 and lift it clear of the rim 24. This will give the user time and space to detach the adhesive 40 from the wastebasket 20 without worrying about interference and difficulty that may arise if the trash within the wastebasket is heavy or otherwise cumbersome. Once the adhesive layer 40 is clear of the rim 24, the user may change their grip on the liner 30, and in some embodiments may twist the top edge 34 so as to engage the adhesive layer 40 with an opposite side of the liner 30 to close or partially close the open end 38. The liner 30 and trash collected therewithin can then be fully removed from the wastebasket 20 and discarded.

Preferably, the adhesive layer 40 is made of a mild adhesive configured to engage the inner surface of the wastebasket 20 to firmly hold the liner 30 in place. The adhesive is selected and configured so as to not leave any residue on the inner surface of the wastebasket 20 when it is removed therefrom. Further, the adhesive layer 40 is configured to preferentially adhere to the liner 30 rather than the inner surface of the wastebasket 20. This can be accomplished in multiple ways. For example, an adhesive can be selected that preferentially bonds to the material used for the liner 30 above materials typically used for wastebaskets. Other embodiments may configure the adhesive layer 40 to have a high tack surface that engages the liner 30 and a low tack surface opposite the high tack surface, for engaging the wastebasket 20.

In the illustrated embodiment the adhesive layer 40 is straight and parallel to the top edge 34, and also extends contiguously about the entire circumference of the liner body 32 without interruption. It is to be understood that, in some embodiments, the adhesive layer 40 may include one or more interruptions in its continuity about the circumference of the liner body 32.

Figure 5:
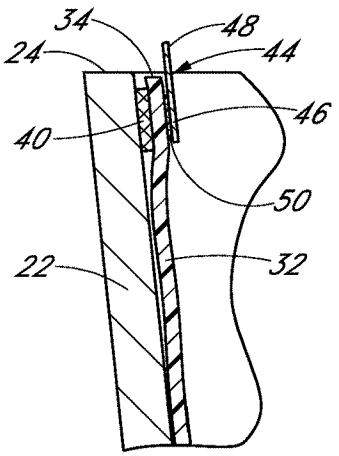
FIG. 5 is a schematic cross-sectional view of another embodiment.

With reference next to FIG. 5, a schematic view of another embodiment of a pull member 44 is presented. In this embodiment, the pull member 44 is formed separately from the liner 30. A connected portion 46 is bonded to the inside surface of the liner 30 by any of various methods, including an adhesive or a heat seal or weld. A free portion 48 of the pull member 44 extends from the connected portion 46 and preferably is sized and configured to be graspable by the user. In the illustrated embodiment the free portion 48 extends upwardly from the connected portion 46 and above the top edge 34 of the liner 30. Preferably, the free portion 48 is not connected to the liner 30, and is free to be grasped and pulled by a user.

The bond 50 between the liner 30 and the connected portion 46 of the pull member 44 is depicted schematically in FIG. 5 and others of the figures discussed herein. It should be appreciated that some bonding methods and structures, such as welding, will not necessarily show a thickness when depicted in actual cross-section. However, the bond 50 is shown schematically in order to illustrate its presence. Preferably, the bond 50 between the liner 30 and the pull member 44 is stronger than the bond between the adhesive layer 40 and the inner surface of the wastebasket 20. As such, when the user pulls on the pull member 44, the adhesive layer 40 will detach from the wastebasket 20, but the pull member 44 will not detach from the liner 30.

In some embodiments the free portion of the pull member can be coated with a high-traction coating on one or both of its surfaces. Also, in some embodiments the free portion of the pull member, or the entire pull member, can be a different color than the rest of the liner so as to make it easy to see and access.

Figure 6:
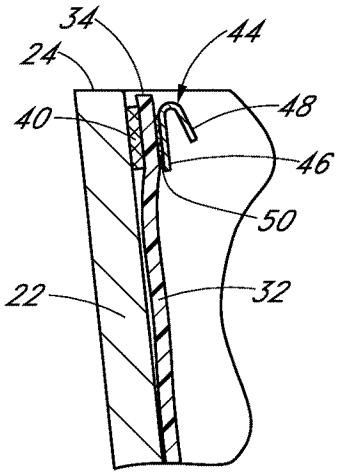
FIG. 6 is a schematic cross-sectional view of yet another embodiment.

FIG. 6 presents another embodiment that is much like FIG. 5 except that the free portion is folded over so that it does not extend above the top edge 34 of the liner 30. As such, the free portion 48 remains accessible for use, but is less likely to extend above the rim 24 of the wastebasket 20, and correspondingly is less likely to interfere with the esthetics of the wastebasket 20. Such bending preferably is imposed during manufacture by any of various methods, such as pressing to impose the bend. It is also to be understood that bends of a wide variety of angles may be imposed, ranging from at or near 150°-180° (as shown) to 90° or even more mild bends such as about 45° or 30°. In another embodiment, a layer of low-tack adhesive can be applied adjacent the bend, but spaced from the free end of the free portion 48, so as to help the free portion 48 remain bent until it is time to remove the liner 30 from the wastebasket 20, while keeping the free end of the free portion 48 easily accessible for grasping by the user, at which time the low-tack adhesive is easily defeated when the user grasps the free portion 48.

Figure 7:
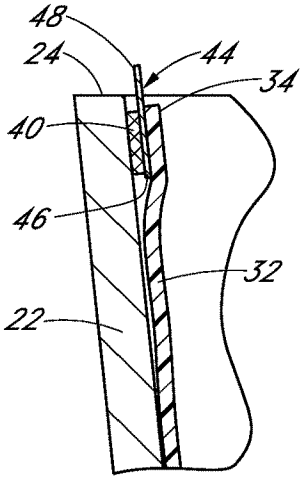
FIG. 7 is a schematic cross-sectional view of still another embodiment.

With reference next to FIG. 7, another embodiment is presented in which the pull member 44 is bonded to the outer surface of the liner 30, and the free portion 48 extends above the top edge 34 of the liner 30. The adhesive layer 40 is attached to the outer surface of the liner 30 as in other embodiments, but at the pull member 44 it is attached via the pull member. In the illustrated embodiment the pull member 44 is positioned so that the adhesive layer is at least partially aligned with the connected portion 46 and its bond 50 between the pull member and liner 30. In another embodiment the adhesive layer 40 may be discontinuous for a short space at and adjacent the pull member 44. As such, initiating pull-off of the liner 30 by pulling radially inward with the pull member 44 may be marginally easier. As with other embodiments, it is to be understood that, if desired, the free portion 48 of the pull member 44 may be folded fully or partially over the top edge 34 of the liner 30.

Figure 9:
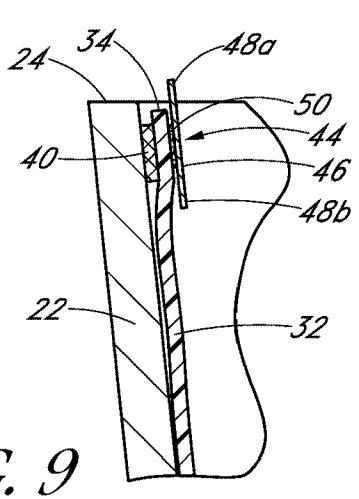
FIG. 9 is a schematic cross-sectional view taken along lines 9-9 of FIG. 8.
Figure 8:
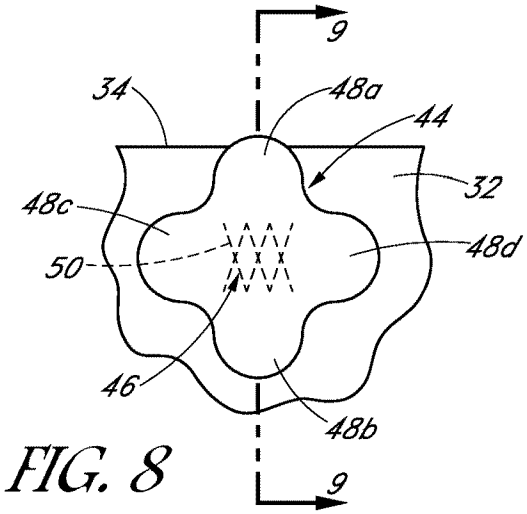
FIG. 8 is a close-up view of another embodiment of a pull member attached to a liner.

With reference next to FIGS. 8 and 9, another embodiment of a pull member 44 comprises a connected portion 46 bonded to the liner 30, and a free portion 48 extending in multiple directions from and around the connected portion 46. More specifically, in the illustrated embodiment, the free portion 48 comprises a top free portion 48*a* that extends upwardly from the connected portion 46, a bottom free portion 48*b* that extends downwardly from the connected portion 46, a first side free portion 48*c* that extends laterally (relative to an axis of the liner 30) from the connected portion 46, and a second side free portion 48*d* that also extends laterally from the connected portion 46. As such, a user can grasp any one or multiple ones of the free portions 48 and when removing the liner 30 from the wastebasket 20.

Figure 10:
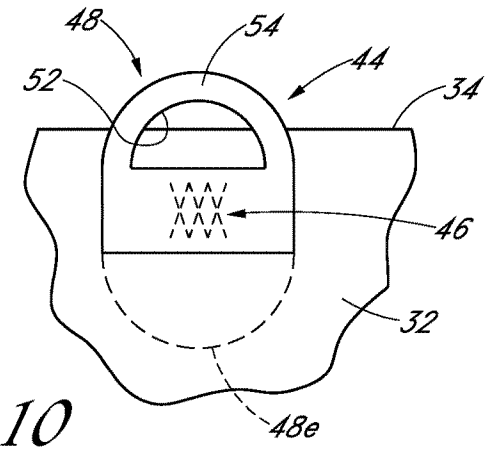
FIG. 10 is a close-up view of yet another embodiment of a pull member attached to a liner.

With reference next to FIG. 10, in another embodiment of a pull member 44, a free portion 48 extending upwardly from the connected portion 46 can have an aperture 52 sized and configured to accommodate a user's finger extending therethrough so as to facilitate the user obtaining purchase on the pull member 44 when removing the liner 30 from the wastebasket 20. A grip portion 54 of the free portion 48 is disposed above the aperture 52. In some embodiments the grip portion 54 can be reinforced, such as by having another layer of material placed or bonded thereto, and/or including a different material, such as an arcuate piece of hard plastic, bonded thereto. A secondary free portion 48*e* may, in some embodiments, extend downwardly from the connected portion 46.

Figure 11:
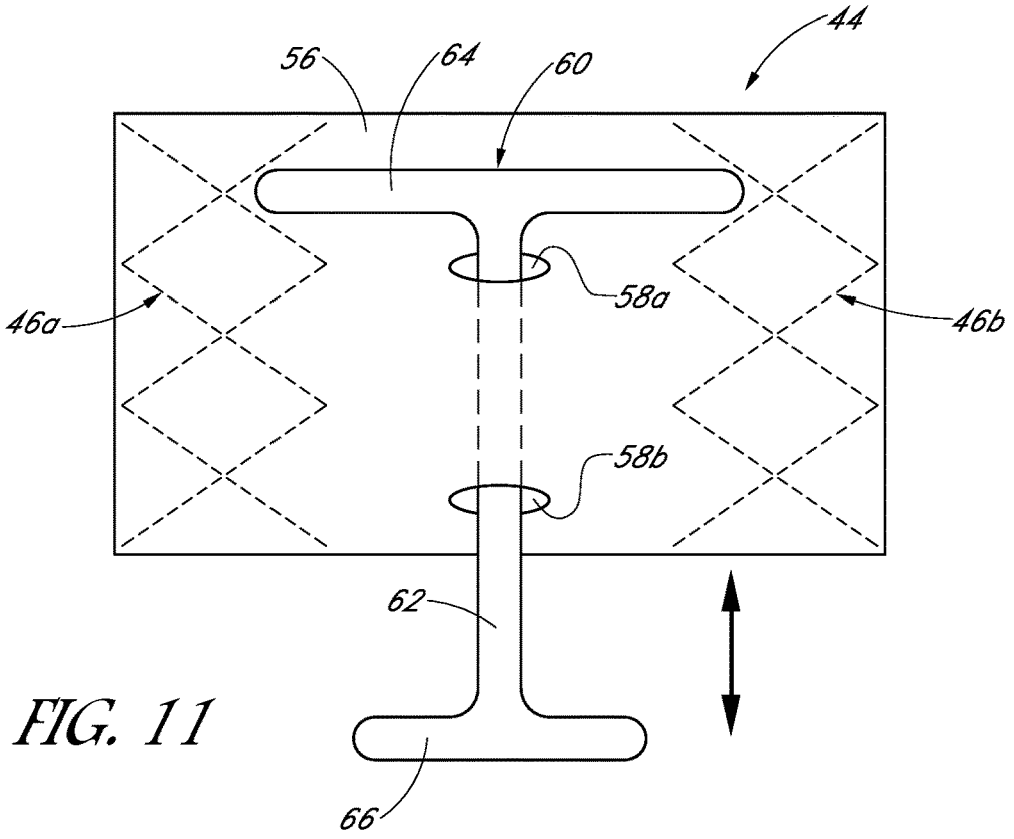
FIG. 11 is a close-up view of still another embodiment of a pull member attached to a liner.

With reference next to FIG. 11, another embodiment of a pull member 44 comprises a plastic base 56 that is bonded to the inner surface of the liner 30 at first and second connected portions 46*a*, 46*b*. Between the connected portions 46*a*, 46*b*, a top aperture 58*a* and a bottom aperture 58*b* are formed through the base 56. A slide member 60 comprises a thin, elongated body 62 having a top handle 64 at one end and a bottom tab 66 at the other. The slide member 60 is fit through the top and bottom apertures 58*a*, 58*b* so that the body 62 can slide up and down. The handle 64 is larger than the top aperture 58*a*, and thus downward sliding of the slide member 60 is stopped when the handle reaches the top aperture 58*a*. The bottom tab 66 is larger than the bottom aperture 58*b*, and thus upward sliding of the slide member 60 relative to the base 56 is stopped when the bottom tab 66 reaches the bottom aperture 58*b*. In a preferred embodiment the slide member 60 is made of a rigid or semi-rigid material such as certain plastics and metals.

When the liner 30 is installed in a wastebasket 20, gravity pulls the slide member 60 downwardly so that the handle 64 rests at the top aperture 58*a*. As such, the handle 64 is below the top edge 34. When the user wishes to remove the liner 30 from the wastebasket 20, the user grasps and pulls on the handle 64. The slide member 60 then slides upwardly relative to the base 56 until the tab contacts the bottom aperture 58*b*. Further pulling force exerted on the handle 64 by the user is then transferred through the base 56 to the liner 30 to remove the liner from the wastebasket. It should be understood that, if desired, the user can use the slide member 60 in an opposite method, pulling down on the tab 66 in order to initially detach a portion of the adhesive layer 40 from the wastebasket 20, and then pulling the handle 64 upwardly to detach the remaining adhesive layer 40 and entire liner 30 from the wastebasket 20.

Figure 12:
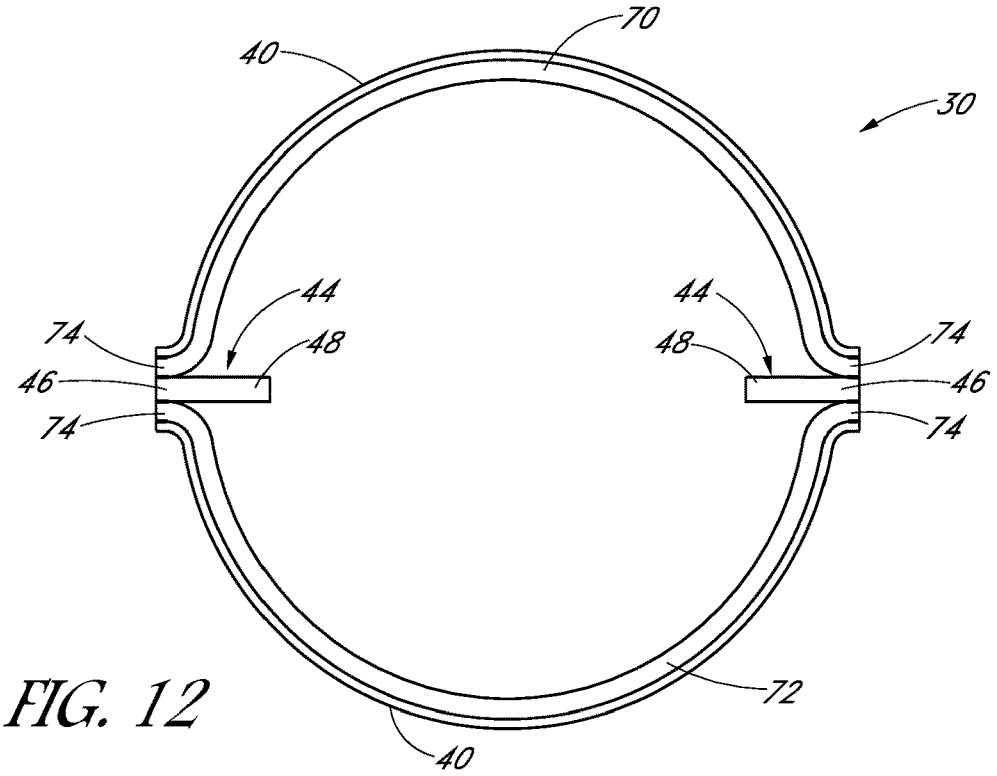
FIG. 12 is a schematic top view of another embodiment of a wastebasket liner.

With reference next to FIG. 12, another embodiment of a liner 30 comprises a first liner wall 70 and a second liner wall 72 that each have opposing first and second edges 74, 76. The first edges 74 of the liner walls 70, 72 are bonded, as are the second edges 76, in order to form the liner 30. A pair of pull members 44 are provided at or adjacent the top edge 34. In the illustrated embodiment, the connected portion 64 of the pull members 44 are sandwiched between the liner walls 70, 72 at the bonded edges 74 or 76, during the bonding process, and thus are similarly bonded, such as by a heat weld. The free portions 48 extend radially inwardly from the connected portions 46. Preferably, the pull members 44 lie flat and parallel to the liner walls 70, 72 before the liner 30 is used, such as when it is disposed on a roll or in a dispenser. When the liner is opened for installation in a wastebasket 20, the free portions 46 can extend inwardly, spaced from the walls 70, 72 and thus be easily accessible to the user when it comes time to remove the liner 30. Preferably, the pull members 44 are disposed only at or adjacent the top edge 34, and thus are only sandwiched between the bonded edges 74, 76 over a portion of the length of the liner walls 70, 72.

Figure 13:
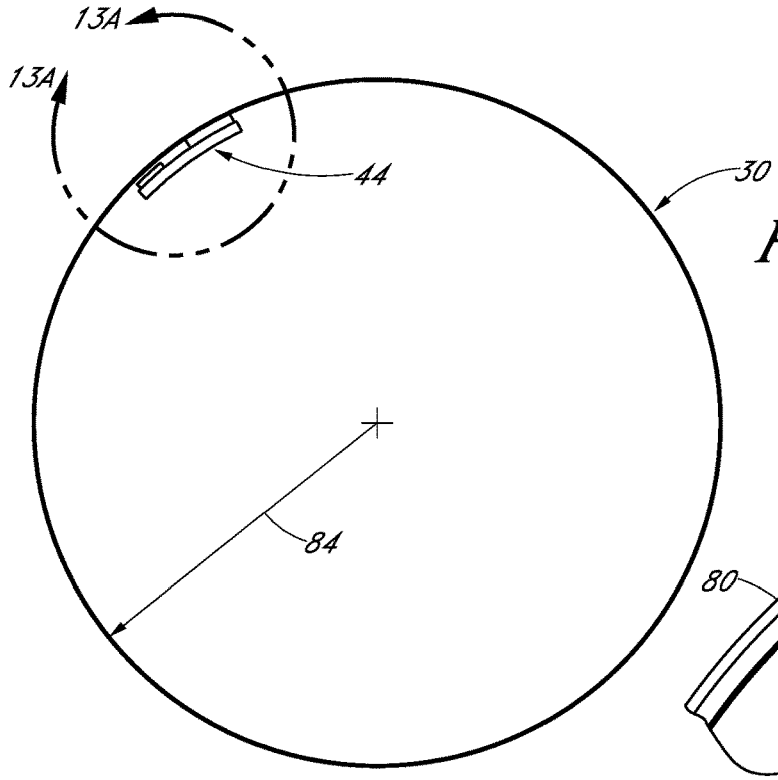
FIG. 13 is a schematic top view of yet another embodiment of a wastebasket liner.
Figure 13A:
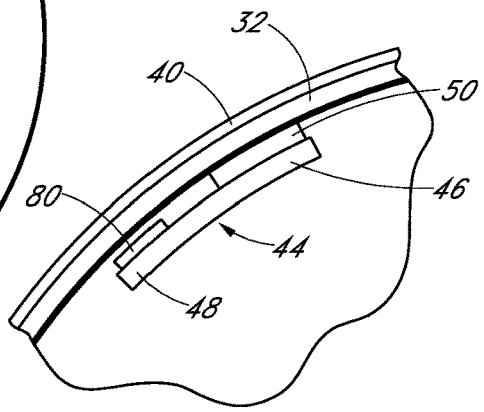
FIG. 13A is a close-up view taken along line 13A-13A of FIG. 13.
Figure 14:
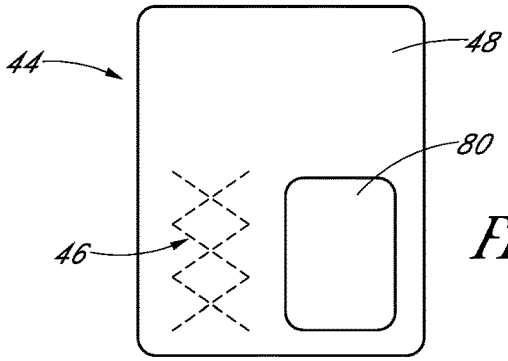
FIG. 14 is a schematic view of a pull member of the configuration of FIG. 13.
Figure 15:
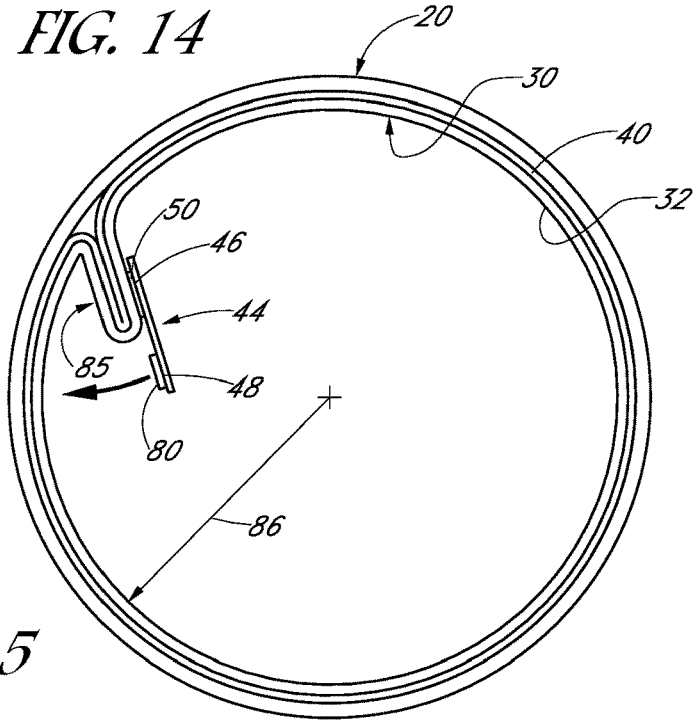
FIG. 15 is a schematic view of the configuration of FIG. 13 being installed in a wastebasket.

With reference next to FIG. 13-15, another embodiment is shown in which the pull member 44 is bonded to the inner surface of the liner 30 at a connected portion 46, and a free portion 48 extends from the connected portion 46. In the illustrated embodiment, part of the free portion comprises a secondary adhesive layer 80, which preferably is covered by a peel-away backing (not shown). In the illustrated embodiment, a radius 84 of the liner 30 is greater than a radius 86 of the wastebasket 20. Thus, the liner 30 doesn't automatically fit correctly within the wastebasket.

In the illustrated embodiment, the user installs the liner 30 into the wastebasket 20 as discussed above. However, the user installs the portions having the pull member 44 last. As shown in FIG. 15, the user adheres the liner 30 substantially about the circumference of the wastebasket 20. An excess portion 85 of the liner 30 is overlapped and adhered to itself, with the pull member 44 disposed at or near the end of the overlapped excess portion 85, and the free portion 48 of the pull member 44 extending therefrom. The user may then remove the peel-off cover of the secondary adhesive layer 80 and push the pull member 44 into contact with the inner surface of the liner 30. As such, the excess portion 85 of the liner 30 is folded over itself and held adjacent and parallel to the inner surface of the liner 30 so that it will not interfere with trash being discarded into the liner 30, and will also not interfere substantially with the esthetics of the wastebasket 20.

Figure 16:
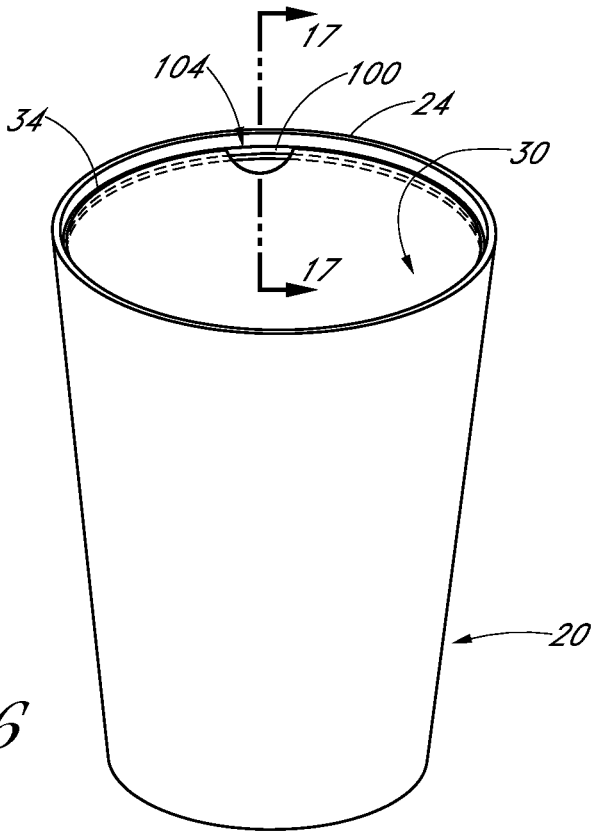
FIG. 16 is a perspective view of still another embodiment of a liner installed in a wastebasket.
Figure 17:
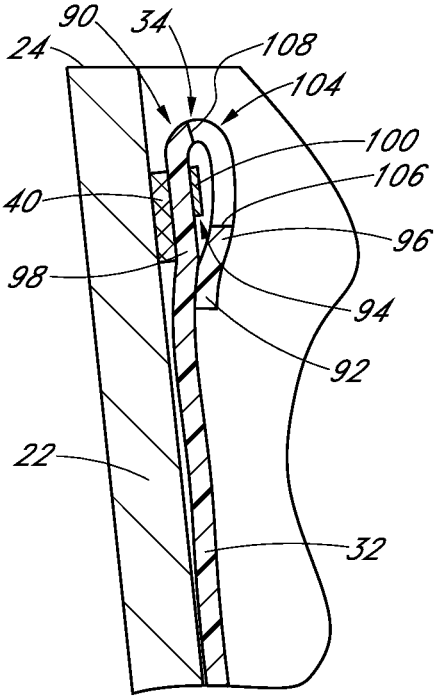
FIG. 17 is a schematic cross-sectional view taken along lines 17-17 of FIG. 16.

With reference next to FIGS. 16 and 17, another embodiment of a liner 30 has a hem 90 formed at its upper end. More specifically, a free end 92 of the liner 30 is folded over at the top edge 34. The free end 92 is bonded, such as via a heat weld, to the liner body 32 to form the hem 90, which defines a hem space 94 therewithin. In the illustrated embodiment the free end 92 is bonded to the inner surface of the liner body 32 and thus forms an inner wall 96 of the hem 90, while the liner body 32 forms an outer wall 98 of the hem 90. It is to be understood that, in some embodiments, this structure can be reversed—such as if the free end 92 is bonded to the outer surface of the liner body 32. A draw tape 100 is disposed within the hem space 94. Preferably both the hem 90 and draw tape 100 extend around the full circumference of the liner 30.

At least one cutout 104 is formed at the hem 90. Preferably the cutout 104 is elongated in the direction of the draw tape 100, and is formed substantially only through the inner wall 96 of the hem 90. A bottom-most portion 106 of the cutout 104 is located through the inner wall 96 and preferably generally below the draw tape 100. A top-most portion 108 of the cutout 104 preferably is generally aligned with the top edge 34 of the liner 30. As such, the user can access the draw tape 100 from the inner side of the liner 30 via the cutout 104 when it is time to remove the liner 30 from the wastebasket 20. Preferably the cutout 104 does not extend substantially past the top edge 34 and into the outer wall 98 of the hem 90. More specifically, preferably the adhesive layer 40 is attached to the outer wall 98 of the hem 90 at a location generally opposite the location of the cutout 104, and the cutout 104 does not interfere with the adhesive layer 40 on the outer wall 98 so that the adhesive layer 40 is uninterrupted at and adjacent the hem 90.

In some embodiments the cutout 104 may extend a short distance beyond the top edge 34 and into the outer wall 98. However, preferably in such embodiments the cutout 104 does not interfere with the linear application of the adhesive 40 on the outer wall 98. In other embodiments the top-most portion 108 of the cutout 104 may be disposed entirely in the inner wall 98 and spaced a short distance from the top edge 34. Preferably, however, the cutout 104 is configured to facilitate a user accessing and obtaining purchase on the draw tape 100.

Figure 18:
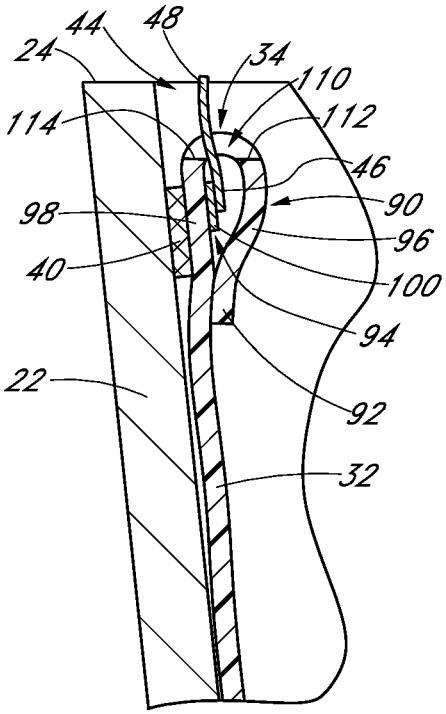
FIG. 18 is a schematic cross-sectional view of a still further embodiment.

With reference next to FIG. 18, another embodiment of a liner 30 employs a draw tape 100 disposed within a hem 90. However, in the illustrated embodiment an elongated cutout 110 is formed so as to remove substantially only the top edge 34. More specifically, an inner side cut 112 is formed in the inner wall 96 and an outer side cut 114 is formed in the outer wall 98. Preferably, the inner side cut 112 is placed so that a distance between the bottom of the hem space 94 (where the free end 92 is bonded to the liner body 32) and the location of the inner side cut 112 is greater than a width of the draw tape 100 so that the draw tape remains inconspicuously within the hem space 94 below the inner side cut 112 but is accessible to a user when needed. In the illustrated embodiment the outer side cut 114 is located opposite and at the same height along the liner 30 as the inner side cut 112. Most preferably the outer side cut 114 is located so that it does not interfere with the adhesive layer 40 disposed on the outer wall 98.

In the illustrated embodiment a pull member 44 is attached to the draw tape 100 in a manner so that the free portion 48 of the pull member 44 extends upwardly through the cutout 110. Preferably the pull member 44 is bonded to the draw tape 100 at a connected portion 46. In additional embodiments, the draw tape 100 may include a pull member 44 unitarily formed therewith and placed so that the pull member 44 is aligned with the cutout 110. Further embodiments may not employ a pull member other than the draw tape 100 itself. It is to be understood that since the draw tape is specifically configured to be grasped by the user during removal of the liner from the wastebasket, the draw tape can be considered a pull member in its own right.

The embodiments discussed above have disclosed structures with substantial specificity. This has provided a good context for disclosing and discussing inventive subject matter. However, it is to be understood that other embodiments may employ different specific structural shapes and interactions. For example, wastebaskets come in many shapes and sizes, yet still may accept liners having features as discussed herewithin. One specific example is a wastebasket having a square-shaped opening. Although the shape is different than specifically shown in this specification, it is to be understood that a liner can be installed and detached from such a wastebasket according to the same principles discussed herein.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A wastebasket liner, comprising:

a body extending from a top edge to a closed bottom, an opening being defined by the top edge, an interior of the liner defined within the body between the opening and the closed bottom;

an adhesive layer disposed on an outer surface of the liner body at or adjacent the top edge, the adhesive layer extending substantially around the circumference of the liner body; and a pull member having a connected portion that is connected to the liner and having a free portion extending from the liner and configured to be graspable by a user, the free portion of the pull member disposed in the interior of the liner and overlapping an inner surface of the liner body;

wherein the pull member does not extend above the top edge of the liner and does not extend out of the interior of the liner.

2. The wastebasket liner of claim 1, wherein the pull member is formed separately from the liner body, and a connected portion of the pull member is bonded to the inner surface of the liner body, and wherein the free portion of the pull member extends from the connected portion within the interior of the liner.

3. The wastebasket liner of claim 1, wherein the free portion of the pull member comprises a high-grip coating.

4. The wastebasket liner of claim 1, wherein the free portion of the pull member is bent downward.

5. The wastebasket liner of claim 1, wherein the pull member comprises a second free portion extending from the connected portion in a direction other than upward.

6. The wastebasket liner of claim 1, wherein the free portion of the pull member comprises a reinforcement member made of a different material than the liner body.

7. A wastebasket liner, comprising:

a liner body extending from a top edge to a closed bottom, an opening being defined by the top edge, the liner body comprising a first liner wall and a second liner wall, a first edge of the first liner wall being bonded to a first edge of the second liner wall along a length of the liner body from the top edge to the closed bottom, and a second edge of the first liner wall being bonded to a second edge of the second liner wall along the length of the liner body;

an adhesive layer disposed on an outer surface of the liner body at or adjacent the top edge, the adhesive layer extending substantially around the circumference of the liner body; and a pull member having a connected portion that is sandwiched between the bonded first edges along a portion of the length of the liner body, and a free portion of the pull member that extends towards the second edges and terminates at a free end that is movable relative to the liner body, the free portion extending from the liner and configured to be graspable by a user, the free portion supported entirely by the connected portion, the connected portion and free portion of the pull member being unitarily formed.

8. The wastebasket liner of claim 7, wherein the free portion extends laterally from the connected portion, and wherein the free portion comprises a secondary adhesive layer.

9. The wastebasket liner of claim 8, wherein the free portion extends both laterally and proximally from the connected portion, and the secondary adhesive layer is disposed on only a portion of the free portion.

10. The wastebasket liner of claim 8, wherein the secondary adhesive layer is configured to selectively engage the inner surface of the liner body.

11. The wastebasket liner of claim 7, wherein the free portion extends laterally from the connected portion and is unattached to either the first liner wall and the second liner wall.

12. The wastebasket liner of claim 11, wherein the free portion does not extend above the top edge.

13. A wastebasket liner, comprising:

a body extending from a top edge to a closed bottom, an opening being defined by the top edge;

a hem at and adjacent the top edge of the liner about the circumference of the opening, the hem comprising an inner wall and an outer wall that define a hem space, a draw tape disposed in the hem space;

an adhesive layer disposed on the outer wall of the hem on an outer surface of the liner body at or adjacent the top edge, the adhesive layer extending substantially around the circumference of the liner body; and a cutout formed through the inner wall so as to provide access to the hem space and the draw tape therewithin, an overlapping portion of the outer wall being opposite to and overlapping the cutout, and the adhesive strip is connected to the overlapping portion of the outer wall opposite the cutout.

14. The wastebasket liner of claim 13, wherein the draw tape comprises a pull member.

15. The wastebasket liner of claim 14, wherein a connected portion of the pull member is bonded to the draw tape, and a free portion of the pull member is configured to be graspable by a user.

16. The wastebasket liner of claim 13, wherein the cutout extends to the top edge of the body.

17. A method of installing a wastebasket liner into a wastebasket, comprising:

advancing the wastebasket liner through an opening of the wastebasket;

removing a cover from an adhesive strip disposed on an outer surface of the wastebasket liner adjacent a top edge of the liner;

adhering the adhesive strip to an inner surface of the wastebasket about a circumference of the wastebasket;

directing an excess portion of the liner radially inwardly and overlapping the liner in the excess portion so that the adhesive strip is adhered to itself in the excess portion and a pull member bonded to an inner surface of the liner is disposed at a radially-inward end of the excess portion;

removing a cover from a secondary adhesive layer disposed on a free portion of the pull member; and adhering the secondary adhesive layer to the inner surface of the liner so that the excess portion lies substantially flat against the inner surface of the liner.

18. The method of claim 17, wherein a connected portion of the pull member is bonded to the inner surface of the liner, and part of the free portion extends proximally from the connected portion.

* * * * *